US006631682B2

(12) United States Patent
Maharaj

(10) Patent No.: US 6,631,682 B2
(45) Date of Patent: Oct. 14, 2003

(54) NON-AQUEOUS CLEANING SYSTEM AND METHOD FOR A PRINTING PRESS RECIRCULATION SYSTEM

(76) Inventor: Telluckram Maharaj, 3451 NW. 35th Ct., Hollywood, FL (US) 33309

( * ) Notice: Subject to any disclaimer, the term of this patent is extended or adjusted under 35 U.S.C. 154(b) by 0 days.

(21) Appl. No.: 09/879,254

(22) Filed: Jun. 13, 2001

(65) Prior Publication Data

US 2003/0000406 A1 Jan. 2, 2003

(51) Int. Cl.[7] ..... B41F 35/00
(52) U.S. Cl. ..... 101/483; 101/424
(58) Field of Search ..... 101/424, 423, 101/425, 483; 134/22.13, 22.14, 22.1, 26; 15/256.51, 256.52

(56) References Cited

U.S. PATENT DOCUMENTS 3,023,168 A * 2/1962 Doan ..... 510/337
3,741,118 A * 6/1973 Carley ..... 101/451
4,435,305 A * 3/1984 Tsoukalas et al. ..... 101/129
4,504,406 A * 3/1985 Dhillon ..... 101/424
4,664,721 A * 5/1987 Valasek ..... 101/424
4,886,553 A * 12/1989 Gillich ..... 101/424
5,858,117 A * 1/1999 Oakes et al. ..... 134/26
6,090,765 A * 7/2000 Black et al. ..... 134/26
6,176,244 B1 * 1/2001 Schouten ..... 134/25.2

* cited by examiner

*Primary Examiner*—Andrew H. Hirshfeld
*Assistant Examiner*—Anthony H. Nguyen
(74) *Attorney, Agent, or Firm*—Scott L. Lampert

(57) ABSTRACT

A non-aqueous composition cleaning system and method for a printing press recirculation system. The cleaning system comprises two powdered compositions, each composition being applied individually to the recirculation system in a two-step process. The first composition is prepared by dry blending 15–30% by weight of an alkaline cleaning agent, 15–30% by weight of a detergent salt, 15–30% by weight of an emulsifying/wetting agent, 15–30% by weight of a silicone antifoam and 0–10% by weight of a free-flowing silica additive. The second composition is prepared by dry blending 20–40% by weight of an organic acid and 60–80% by weight of a non-foaming detergent/wetting agent. The method comprises dissolving 10 to 40 grams of the first composition in 45 to 200 milliliters of water for each gallon of fountain solution and pouring the resultant solution into the printing press recirculation system. The resultant mixture is then allowed to recirculate for at least 30 minutes. 5 to 25 grams of the second composition is then dissolved in 40 to 200 milliliters of water for each gallon of fountain solution and the resultant solution poured into the recirculation system. The recirculation system is then run for an additional 10 minutes before being drained, flushed with clean water and the refilled with fresh fountain solution.

20 Claims, No Drawings

NON-AQUEOUS CLEANING SYSTEM AND METHOD FOR A PRINTING PRESS RECIRCULATION SYSTEM

BACKGROUND OF THE INVENTION

1. Field of the Invention

The present invention relates to lithographic printing operations and, more particularly, to a non-aqueous cleaning system and method for a printing press recirculation system.

2. Description of the Related Art

Offset printing, or lithography, is a printing technique in which the image to be printed is fixed on a generally flat plate. The lithographic process is based on the principle that oil and water do not mix. Using this principle, the offset printing plate is constructed so that the image areas are ink receptive and lipophilic or water repellant and the non-image areas are hydrophilic or water receptive and ink repellant. Fountain solutions, also referred to as dampening solutions, are the agents used in lithography to wet the non-image area of the plate and repel the ink from such non-image areas.

In use, the typical process for applying fountain solution to the printing plate involves recirculating the fountain solution from a reservoir, through pipes or lines, into a pan on the press where it is applied to the plate by means of a roller system. The constant recirculation of the fountain solution after it has contacted the printing plate leads to the build up of ink, paper lint, gum residues, mold and various contaminants in the recirculation system. As the contaminants build up in the recirculation system, the fountain solution performance degrades and eventually needs to be drained from the system and the system cleaned and refilled with fresh fountain solution.

Several products exist in the industry to clean printing press recirculating systems. All of these prior art products are in liquid form. The typical methodology on which these prior art liquid cleaners are premised involves the following process:

1. Draining and flushing the contaminated fountain solution from the recirculating system;
2. Adding water into the recirculating system;
3. Adding the liquid cleaner into the recirculating system;
4. Running the recirculating system to allow the liquid cleaner to circulated through the system;
5. Draining and flushing the cleaning liquid from the recirculating system; and
6. Adding new fountain solution into the recirculating system.

Frequently, the above process must be repeated more than once to adequately clean the recirculating system.

Although somewhat effective for their intended purpose, the prior art liquid cleaning solutions and methodology include several inherent deficiencies. First, the liquid nature of these solutions causes the containers holding such solutions to be heavy and cumbersome, resulting in significant storage, handling and freight costs. Moreover, the liquid nature of these solutions increases the potential of environmental contamination following spillages and exposure to potentially harmful vapors from VOCs during manufacture and use of the solutions.

Second, the current methodology requires that the contaminated fountain solution be drained and flushed from the recirculating system and fresh water added to the recirculating system prior to the application of the liquid cleaner. In today's age of increased costs, increased competition and reduced margins, businesses today are constantly striving to find new ways to accomplish tasks in a more efficient and more cost effective manner.

Accordingly, there is still a need in the art for a simplified and more efficient and cost effective means to clean a printing press recirculating system. Any such system should (1) reduce the number of steps and, consequently, the time required to clean a printing press recirculating system, (2) reduce the handling, transportation and storage costs associated with prior art liquid cleaners and (3) reduce the potential health and environmental hazards associated with prior art liquid cleaners. The present invention is particularly suited to overcome those problems which remain in the art in a manner not previously known.

SUMMARY OF THE INVENTION

The present invention is directed towards a novel, non-aqueous cleaning system and method for a printing press recirculation system. The cleaning system comprises two powdered compositions. The first composition is prepared by dry blending 15–50% by weight of an alkaline cleaning agent, 15–50% by weight of a detergent salt, 15–50% by weight of an emulsifying/wetting agent, 0–30% by weight of a silicone antifoam and 0–10% by weight of a free-flowing silica additive. The second composition is prepared by dry blending 20–40% by weight of an organic acid and 60–80% by weight of a non-foaming detergent/wetting agent. In use, ten (10) to forty (40) grams of the first composition is dissolved in forty-five (45) to two hundred (200) milliliters of water and the resultant solution is poured into the recirculation system for each gallon of contaminated dampening fountain solution and allowed to recirculate for at least thirty (30) minutes. Five (5) to twenty-five (25) grams of the second composition is then dissolved in forty (40) to two hundred (200) milliliters of water, the resultant solution poured into the recirculation system and the recirculation system is run at least an additional ten (10) minutes. The recirculation system is then drained, flushed with clean water and refilled with fresh fountain solution.

It is an object of the present invention to provide a printing press recirculation system cleaning system and method that has all the advantages of the prior art and none of the disadvantages.

It is another object of the present invention to provide a simplified and more efficient and cost effective means to clean a printing press recirculating system.

It is still a further object of the present invention to provide a cleaning system for a printing press recirculation system which reduces the handling, transportation and storage costs associated with liquid cleaners.

It is also an object of the present invention to provide such a system that may be conveniently packaged, shipped and stored in an efficient, economical and environmentally safe manner.

It is yet another object of the present invention to provide such a system that minimizes reduces VOC emissions and the corresponding potential health and environmental hazards associated with liquid cleaners.

It is yet a further object of the present invention to provide a more efficient method of cleaning a printing press recirculation system by reducing the number of steps and, consequently, the time required to clean a printing press recirculation system.

These and other objects and advantages of the present invention will become more readily apparent in the description that follows.

DETAILED DESCRIPTION OF THE PREFERRED EMBODIMENT

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

The present invention is directed towards a new and improved non-aqueous cleaning system and method for a printing press recirculation system. The cleaning system comprises two powdered compositions, each composition being applied to the recirculation system in a two-step process. The first composition is prepared by dry blending 15–30% by weight of an alkaline cleaning agent, 15–30% by weight of a detergent salt, 15–30% by weight of an emulsifying/wetting agent, 15–30% by weight of a silicone antifoam and 0–10% by weight of a free-flowing silica additive. The second composition is prepared by dry blending 20–40% by weight of an organic acid and 60–80% by weight of a non-foaming detergent/wetting agent.

The alkaline cleaning agent is structured to remove fountain solution residue and paper contamination. Additionally, the alkaline cleaning agent provides corrosion protection to the system. The alkaline cleaning agent is preferably sodium metasilicate. However, other suitable water-soluble silicate compounds may, alternatively, be employed.

The detergent salt functions to suspend and chelate insoluble metal salts normally found in inks and increase the effectiveness of the alkaline cleaning agent. In the preferred embodiment, the detergent salt is preferably sodium tripolyphosphate, although other alkaline phosphate salts may be used.

The emulsifying/wetting agent removes oily residues in the recirculating systems, such as inks and ink oils. In the preferred embodiment, the emulsifying/wetting agent is of the alkyaryl-type, such as that manufactured by Stepan Company under the brand name Nacconnol 90 G, which has high detergency and relatively low foaming characteristics compared with other detergents.

The alkaline cleaning agent, detergent salt and emulsifying/wetting agent are foaming materials. Accordingly, the antifoam is used to prevent the formation of foam, which may result in overflow, and to facilitate removal and flushing of the contaminated fountain solution. In the preferred embodiment, the anti-foaming agent is of a silicone-type, such as that manufactured by Dow Chemical Company under the name Q2-3183. The defoaming capabilities of this particular agent is superior to other anti-foaming agents due to its hydrophobic silica content and its stability in the alkaline medium of this composition.

The silica additive functions to make the mixture a free-flowing powder, which prevents clumping and allows for easy dissolution. The silica additive is preferably of the type manufactured by Degussa Corporation under the brand name Sipernat 50 S, due to its ability to accommodate a high moisture load and still maintain its free-flow properties. However, other suitable silica additives may, alternatively, be used.

The organic acid used in the second composition functions to re-acidify the cleaning agents of the first composition after the first composition has been circulated through and cleaned the recirculation system, thereby preventing cleaner residue from contaminating the replacement fountain solution added to the recirculation system after the old, contaminated fountain solution is drained and the system flushed. This is necessary because the pH of the fountain solution, which is typically between 3.5 and 5.5, rises to approximately 12 after the first composition is added. Thus, the second composition acts to lower the pH back to the 3.5 to 5.5 range. In the preferred embodiment, malic acid is the organic acid because of its low tendency to form insoluble metal precipitates in the solution being cleaned. However, any suitable powdered, non-corrosive acid may, alternatively, be employed.

The non-foaming detergent/wetting agent of the second composition acts as an added cleaner, facilitating removal of loosened debris during flushing. The preferred detergent/wetting agent is sodium xylene sulfonate because it is non-foaming and has minimal effect on the pH of the acidifying solution. Other non-foaming alkylaryl sulfonates may, alternatively, be used.

In use, ten (10) to forty (40) grams of the first composition is dissolved forty-five (45) to two hundred (200) milliliters of water and the resultant solution is poured into the printing press recirculating tank for each gallon of contaminated dampening fountain solution. The resultant mixture is then allowed to recirculate for at least thirty (30) minutes (Step 1).

Five (5) to twenty-five (25) grams of the second composition is then dissolved in forty (40) to two hundred (200) milliliters of water and the resultant solution poured into the recirculating tank. The recirculation system is then run for at least an additional ten (10) minutes (Step 2). The recirculation system is then drained, flushed with clean water and the tank refilled with fresh fountain solution.

It should be appreciated that the composition of the present invention may be embodied in a wide range of operable formulations as illustrated by the examples below. The composition may be provided in solid or powder form and is structured to be dissolved in water prior to being added to the recirculation system sump tank. Although pre-dissolving the powder or solid in water attains a greater degree of accuracy, the powder could, alternatively, be added directly to the sump tank. Each of the compositions disclosed in the following examples were formulated in a free-flowing powder form.

EXAMPLES OF FORMULATIONS OF THE FIRST COMPOSITION (STEP 1)

Mixtures of the three principal cleaning agents of step 1 were dissolved in water according to the usage directions for the powder and added to the contaminated water of a five gallon recirculating system of a 26" Ryobi 460K printing press.

| | EX. 1 | EX. 2 | EX. 3 | EX. 4 |
|---|---|---|---|---|
| Sodium Metasilicate | 20 grams | 36 grams | 52 grams | 36 grams |
| Sodium Tripoly-phosphate | 20 grams | 36 grams | 52 grams | 36 grams |
| Nacconol 90G | 20 grams | 36 grams | 52 grams | 36 grams |
| Dow Corning Q2-3183 A | 0 grams | 0 grams | 0 grams | 36 grams |
| Sipernat 50 S | 0 grams | 0 grams | 0 grams | 6 grams |

EXAMPLES OF FORMULATIONS OF THE SECOND COMPOSITION (STEP 2)

| Ingredient | EX. 1 | EX. 2 | EX. 3 |
|---|---|---|---|
| Malic acid | 33 grams | 33 grams | 33 grams |
| Sodium Xylene sulfonate | 57 grams | 33 grams | 75 grams |

The cleaning ability of each of these formulations was compared to a liquid cleaner (Allied Dampening Systems Cleaner) presently manufactured by Allied Pressroom Chemistry. Mixtures of the three principal cleaning agents of the first composition (step 1) of each formulation were dissolved in 750 milliliters of water and added to the contaminated water of a five gallon recirculating system of a 26" Ryobi 460K printing press.

The concentrations in Example 2 provided the optimum balance between cleaning efficiency and ease of dispersal. The formulations of Example 1, Example 2 and Example 3 used no Dow Corning Q2-3183A antifoam and performed effectively. Additionally, no Sipernat Silica additive was needed in the formulations of Example 1, Example 2 and Example 3 to transform the mixture into a free-flowing powder.

Quantities of Dow Corning Q2-3183A antifoam and Sipernat Silica additive were used in the formulation of Example 4 and also performed effectively. However, the addition of these components in the formulation of Example 4 did not result in improved performance over the formulations of Examples 1, 2 or 3. Moreover, excessive concentrations of these two components could result in the formation of deposits in the recirculation system that would be difficult to flush out in the rinse phase of the cleaning operation.

The effectiveness of the second composition (Step 2) in reducing the pH of the cleaning solution is based on use of the proper concentration of malic acid. It is desired to use quantities of malic acid sufficient to reduce the cleaning solution from a pH of 12, which results from the application of the first composition to the old fountain solution, to a pH of between 3.5 and 5.5, which is the typical pH range of fountain solutions, so that the new fountain solution added to the recirculation system after the contaminated solution is drained and the system flushed, is not affected. The second composition was found to be most effective in achieving this objective when 33 grams of malic acid was used. However, it should be appreciated that other amounts of malic acid may, alternatively, be used.

The sodium xylene sulfonate in the second composition facilitates the removal of the debris loosened in the recirculation system by the first composition. The second composition was tested using sodium xylene sulfonate levels of between 33 grams and 75 grams, along with 33 grams of malic acid. In each instance, the composition was effective in reducing the pH level of the contaminated fountain solution to between 4 and 5 and allowing for the removal of the loosened debris. The best results were achieved using 57 grams of sodium xylene sulfonate, which provided the most efficient removal of the loosened debris. However, it should be appreciated that other amounts of sodium xylene sulfonate may, alternatively, be used.

The foregoing examples illustrate that the non-aqueous recirculation system cleaning composition of the present invention may be embodied in a wide range of operable formulations and is suitable for use in all types and sizes of offset lithographic dampening solution recirculation systems, from small single color presses to large format web offset presses. Moreover, it is capable of use with commercially available fountain solution concentrates that are in use with these presses without contributing to additional VOC emissions and their attendant environmental and health hazards.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended.

What is claimed is:

1. A non-aqueous cleaning system for a printing press recirculation system comprising a first composition having quantities of 15–30% by weight of an alkaline cleaning agent, 15–30% by weight of a detergent salt, 15–30% by weight of an emulsifying/wetting agent, 15–30% by weight of an antifoam and 0–10% by weight of a free-flow additive and a second composition having quantities of 20–40% by weight of an organic acid and 60–80% by weight of a non-foaming detergent/wetting agent.

2. A non-aqueous cleaning system for a printing press recirculation system as recited in claim 1 wherein said alkaline cleaning agent is a silicate compound.

3. A non-aqueous cleaning system for a printing press recirculation system as recited in claim 2 wherein said silicate compound is sodium metasilicate.

4. A non-aqueous cleaning system for a printing press recirculation system as recited in claim 1 wherein said detergent salt is an alkaline phosphate compound.

5. A non-aqueous cleaning system for a printing press recirculation system as recited in claim 4 wherein said alkaline phosphate salt is sodium tripolyphosphate.

6. A non-aqueous cleaning system for a printing press recirculation system as recited in claim 1 wherein said emulsifying/wetting agent is of the alkyaryl-type.

7. A non-aqueous cleaning system for a printing press recirculation system as recited in claim 1 wherein said antifoam is a silicone emulsion with hydrophobic silica additive.

8. A non-aqueous cleaning system for a printing press recirculation system as recited in claim 1 wherein said free-flow additive is hydrophobic silica.

9. A non-aqueous cleaning system for a printing press recirculation system as recited in claim 1 wherein said organic acid is selected from a group consisting of citric, malic and succinic acid.

10. A non-aqueous cleaning system for a printing press recirculation system as recited in claim 1 wherein said non-foaming detergent/wetting agent is selected from the sulfonate group of surfactants.

11. A non-aqueous cleaning system for a printing press recirculation system as recited in claim 10 wherein said non-foaming detergent/wetting agent is sodium xylene sulfonate.

12. A method of cleaning a printing press recirculation system using a first alkaline composition structured to loosen residue from the recirculation system and a second composition structured to acidify the solution formed by the addition of the first composition to the fountain solution comprising the steps of:

(i) dissolving the first composition in water;

(ii) pouring the quantity of solution from step (i) into the fountain solution in a printing press recirculation system;

(iii) running the recirculation system;

(iv) dissolving the second composition in water;

(v) pouring the quantity of solution from step (iv) into the recirculation system;

(vi) running the recirculation system;

(vii) draining the recirculation system; and (viii) flushing the recirculation system with clean water.

13. A method of cleaning a printing press recirculation system as recited in claim 12 wherein said first composition is non-aqueous and comprises quantities of 15–30% by weight of an alkaline cleaning agent, 15–30% by weight of a detergent salt, 15–30% by weight of an emulsifying/wetting agent, 15–30% by weight of an antifoam and 0–10% by weight of a free-flowing additive.

14. A method of cleaning a printing press recirculation system as recited in claim 13 wherein step (i) comprises dissolving 10–40 grams of the first composition in 45 to 200 milliliters of water for each gallon of fountain solution.

15. A method of cleaning a printing press recirculation system as recited in claim 14 wherein step (iii) comprises running the recirculation system for at least 30 minutes.

16. A method of cleaning a printing press recirculation system as recited in claim 12 wherein said second composition is non-aqueous and comprises quantities of 20–40% by weight of an organic acid and 60–80% by weight of a non-foaming detergent/wetting agent.

17. A method of cleaning a printing press recirculation system as recited in claim 16 wherein step (iv) comprises dissolving 5–25 grams of the second composition in 40 to 200 milliliters of water for each gallon of fountain solution.

18. A method of cleaning a printing press recirculation system as recited in claim 17 wherein step (vi) comprises running the recirculation system for at least 10 minutes.

19. A method of cleaning a printing press recirculation system using a first composition having quantities of 15–30% by weight of an alkaline cleaning agent, 15–30% by weight of a detergent salt, 15–30% by weight of an emulsifying/wetting agent, 15–30% by weight of an antifoam and 0–10% by weight of a free-flowing additive and a second composition having quantities of 20–40% by weight of an organic acid and 60–80% by weight of a non-foaming detergent/wetting agent comprising the steps of:

(i) dissolving 10–40 grams of the first composition in 45 to 200 milliliters of water for each gallon of fountain solution;

(ii) pouring the solution from step (i) into a printing press recirculation system containing fountain solution;

(iii) running the recirculation system;

(iv) dissolving 5 to 25 grams of the second composition in 40 to 200 milliliters of water for each gallon of fountain solution;

(v) pouring the solution from step (iv) into the recirculation system;

(vi) running the recirculation system;

(vii) draining the recirculation system; and (viii) flushing the recirculation system with clean water.

20. A method of cleaning a printing press recirculation system as recited in claim 19 wherein step (iii) comprises running the recirculation system for at least 30 minutes and step (vi) comprises running the recirculation system for at least 10 minutes.

* * * * *